US007673874B2

(12) United States Patent
Arai et al.

(10) Patent No.: US 7,673,874 B2
(45) Date of Patent: Mar. 9, 2010

(54) PAPER SHEET HANDLING APPARATUS

(75) Inventors: Kentaro Arai, Nagareyama (JP); Atsuko Uozumi, Owariasahi (JP); Takeshi Kanagawa, Owariasahi (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 11/779,902

(22) Filed: Jul. 19, 2007

(65) Prior Publication Data

US 2008/0038038 A1 Feb. 14, 2008

(30) Foreign Application Priority Data

Aug. 10, 2006 (JP) ..... 2006-217961

(51) Int. Cl.
*B65H 7/02* (2006.01)

(52) U.S. Cl. ..... 271/258.01; 271/259; 271/258.02; 209/534

(58) Field of Classification Search ..... 271/258.01, 271/259, 258.02; 209/534; 53/54; 270/58.07
See application file for complete search history.

(56) References Cited

U.S. PATENT DOCUMENTS 4,376,364 A * 3/1983 Horino et al. ..... 53/54
4,513,439 A 4/1985 Gorgone et al.
4,928,230 A 5/1990 Kawamura et al.
5,173,590 A * 12/1992 Nakano et al. ..... 235/379
5,421,463 A * 6/1995 Okazaki et al. ..... 209/559
6,006,209 A 12/1999 Takeuchi et al.
6,773,009 B2 * 8/2004 So ..... 271/259
7,017,902 B2 * 3/2006 Kuru et al. ..... 271/258.02
7,131,539 B2 * 11/2006 Mukai ..... 209/534
7,140,610 B2 * 11/2006 Kako et al. ..... 271/258.01
2005/0091159 A1 4/2005 Ichikawa et al.
2005/0189266 A1 * 9/2005 Fujita et al. ..... 209/534

FOREIGN PATENT DOCUMENTS

JP 01076181 A * 3/1989
JP 05254686 A * 10/1993
JP 06-219596 8/1994
JP 11-007568 1/1999

* cited by examiner

*Primary Examiner*—Patrick H Mackey
*Assistant Examiner*—Luis Gonzalez
(74) *Attorney, Agent, or Firm*—Antonelli, Terry, Stout & Kraus, LLP.

(57) ABSTRACT

A paper-money receipt/payment machine comprises a conveyance path, on which paper sheet can be conveyed in dual directions, and a paper-money discrimination unit provided midway the conveyance path to discriminate the paper sheet. The machine further comprises a temporary holding unit for storage of rejected paper sheet to be rejected, and an exclusive storage box, separately provided from the temporary holding unit, for storage of jammed paper sheet. The exclusive storage box is arranged at one end or both ends of the conveyance path.

4 Claims, 13 Drawing Sheets

PAPER SHEET HANDLING APPARATUS

INCORPORATION BY REFERENCE

The present application claims priority from Japanese application JP2006-217961 filed on Aug. 10, 2006, the content of which is hereby incorporated by reference into this application.

BACKGROUND OF THE INVENTION

The present invention relates to a paper sheet handling apparatus, in which, for example, a paper sheet is handled.

Conventionally, paper-money handling apparatuses used in, for example, monetary facilities, etc. are not only mounted in plural in bank branches or the like but also mounted singly in stores such as supermarkets, convenience stores, etc. in some cases. In case of being singly mounted in this manner, when an obstacle such as jam of paper money in conveyance occurs, a maintenance personnel is required to go to a location, in which a paper-money handling apparatus is mounted, to remove jammed paper money. Therefore, when a paper-money handling apparatus is stopped due to an obstacle such as jam in conveyance, etc., it takes long time until the paper-money handling apparatus is again operated. In this manner, when a single paper-money handling apparatus present in a store stops for a long time, there is caused a problem that users and monetary facilities are annoyed much.

On the other hand, in order to solve such problem, a paper-money dispenser is proposed, in which when jam of paper money occurs, the jammed paper money is moved from a jam position by repeatedly rotating a conveyance path motor predetermined times in forward and backward directions at a slower speed than a normal conveyance speed (JP-A-6-219596). With the paper-money dispenser, jammed paper money is removed by storing the jammed paper money in a reject cashbox and resumption of a paper-money handling apparatus is performed without intervention of a maintenance personnel.

Also, in order to automatically check presence or absence of an accumulated article on a conveyance path and clean the conveyance path, an automatic resumption method for an automatic transaction facility management system is proposed, in which a medium such as sheet for checking the conveyance path is caused to flow on the conveyance path to remove an accumulated article and to check the conveyance path (JP-A-11-7568). The automatic resumption method for an automatic transaction facility management system is said to enable automatic resumption of a paper-money handling apparatus without intervention of a maintenance personnel.

With the method and the apparatus described above, however, it is necessary to once store jammed paper money in a temporary storage unit and to then convey the jammed paper money to a separate storage box such as a reject box. Therefore, in the case where paper money is folded and jammed in a state, in which it cannot be discharged again, the jammed paper money cannot be stored in the reject box and automatic resumption cannot be made in some cases.

Also, in order to confirm presence or absence of remains on a conveyance path, there is a need for a large space in an apparatus for the provision of an exclusive mechanism for discharge/storage of a conveyance path check sheet.

Also, with an apparatus for confirmation of presence or absence of remains on a conveyance path with the use of a conveyance path check sheet, it is possible that in one-way conveyance, the conveyance path check sheet collides against remains on the conveyance path to cause jam whereby the conveyance path check sheet itself cannot be removed, thus making automatic resumption impossible.

SUMMARY OF THE INVENTION

It is an object of the invention to provide a paper-money handling apparatus, resumption of which can be fully automated without intervention of a maintenance personnel/a clerk in charge.

The invention is characterized by a paper sheet handling apparatus having a conveyance path capable of conveyance of paper sheet in dual directions and a discrimination unit provided midway the conveyance path to discriminate the paper sheet, the apparatus separately comprising a rejected paper sheet storage box for storage of rejected paper sheet being rejected, and a jammed paper sheet storage box for storage of jammed paper sheet being jammed, and wherein the jammed paper sheet storage box is arranged at one end or both ends of the conveyance path.

Other objects, features and advantages of the invention will become apparent from the following description of the embodiments of the invention taken in conjunction with the accompanying drawings.

DETAILED DESCRIPTION OF THE INVENTION

Embodiments of the paper-money receipt/payment machine according to the invention will be described hereinafter with reference to the drawings.

First Embodiment

In a paper-money handling apparatus capable of conveyance in dual directions, an explanation is first given to a paper-money receipt/payment machine 1 according to a first embodiment, in which an exclusive storage box 202 as a jammed paper sheet storage box capable of storage of jammed paper money and discharge/storage of a conveyance path check sheet 207 as a conveyance-path confirming medium is mounted at one end (in particular, one end of a conveyance path capable of conveyance in dual directions) of a paper-money conveyance path.

Figure 1:
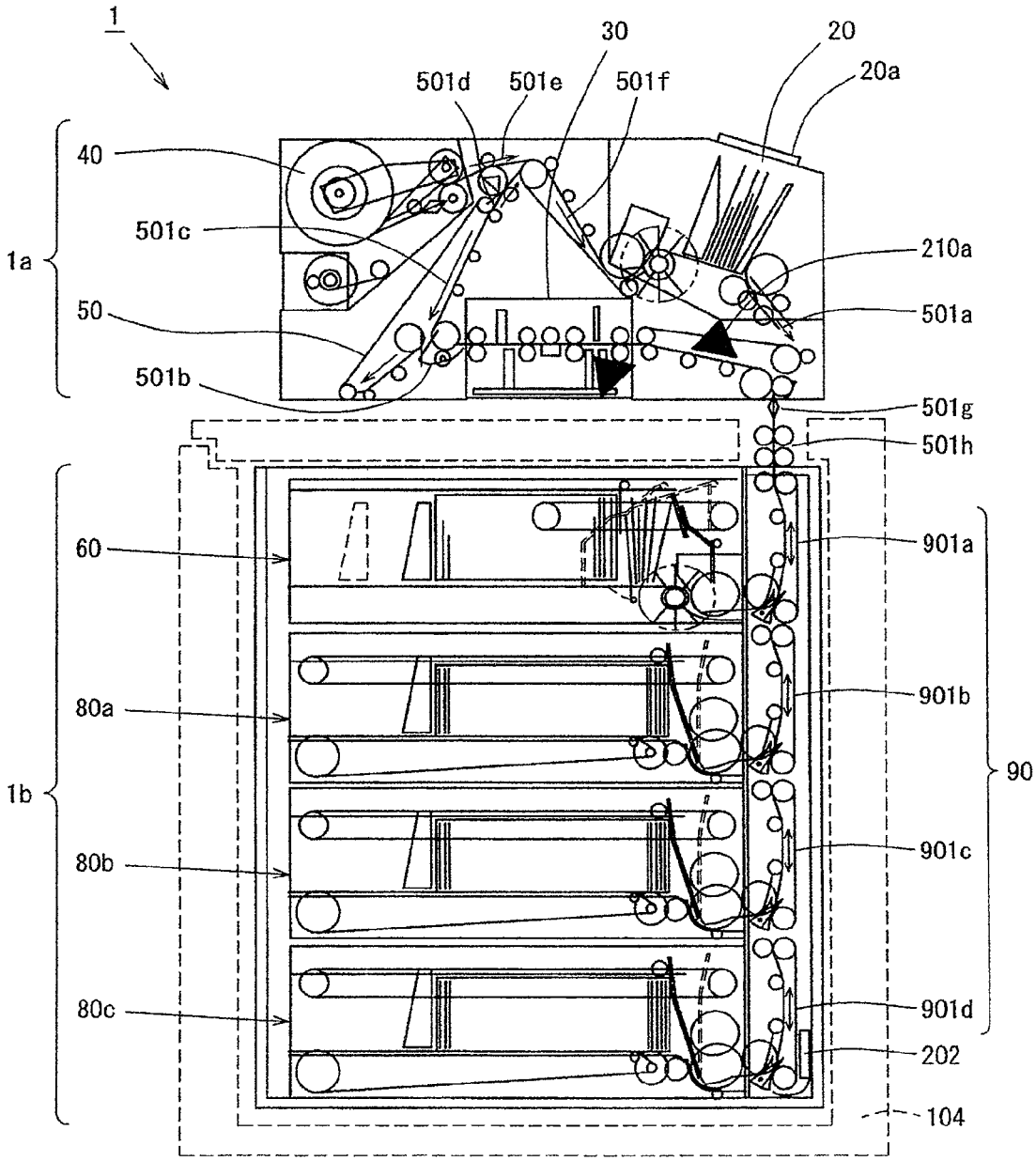
FIG. 1 is a side view showing construction of a first embodiment of a paper-money receipt/payment machine according to the invention.

FIG. 1 is a side view showing the construction of the first embodiment of the paper-money receipt/payment machine 1 according to the invention. The paper-money receipt/payment machine 1 comprises an upper paper-money mechanism 1*a* and a lower paper-money mechanism 1*b*, which are connected to each other by a connected conveyance path 501*h*.

The upper paper-money mechanism 1*a* includes a money receipt/payment opening 20, a paper-money discrimination unit 30 as a differentiation unit, a temporary holding unit 40 as a paper sheet storage unit, and an upper conveyance path 50. Paper-money conveyance paths 501*a* to 501*g* are connected to define the upper conveyance path 50, and paper money is conveyed among the money receipt/payment opening 20, the paper-money discrimination unit 30, the temporary holding unit 40, and the lower paper-money mechanism 1*b*. Sensors such as a conveyance-path paper-money passage sensor 210*a*, etc. are provided in a plurality of locations on the upper conveyance path 50. These sensors function as jam detection means to detect an accumulated article/jammed paper money on the conveyance path.

The lower paper-money mechanism 1*b* includes a money reception box 60, recycle boxes 80*a* to 80*c*, and an openable lower conveyance path 90 arranged on the front of the respective storage boxes (60, 80*a* to 80*c*). Paper-money conveyance paths 901*a* to 901*d* are connected to define the lower conveyance path 90, and paper money is conveyed among the money reception box 60, the recycle boxes 80*a* to 80*c*, and an exclusive storage box 202.

The lower paper-money mechanism 1*b* is mounted in a safe housing 104 made of an iron plate having a thickness in the order to about 50 mm, and the paper-money conveyance path 501*g* of the upper paper-money mechanism 1*a* and the paper-money conveyance path 901*a* of the lower paper-money mechanism 1*b* are connected to each other by the connected conveyance path 501*h*.

The connected conveyance path 501*h* is arranged in a slit provided in a position, in which the paper-money conveyance path 501*g* of the upper paper-money mechanism 1*a* and the paper-money conveyance path 901*a* of the lower paper-money mechanism 1*b* are connected to each other, on an upper surface iron plate portion of the safe housing 104, which surrounds the lower paper-money mechanism 1*b*. The slit formed on the upper surface iron plate portion is sized to have a length, through which paper money passes, and a width of conveyance rollers, which are mounted to interpose therebetween paper money conveyed to the slit to pay out the same. There is not necessarily a need of providing a slit when the upper paper-money mechanism 1*a* is put directly on the lower paper-money mechanism 1*b* in case of adopting a construction, in which the lower paper-money mechanism 1*b* is not surrounded by the safe housing. Drive sources, for example, motors may be provided separately on the upper conveyance path 50 of the upper paper-money mechanism 1*a* and the lower conveyance path 90 of the lower paper-money mechanism 1*b*, but a single drive source may be used to permit a driving force thereof to be transmitted by gears provided between the paper-money conveyance path 501*g*—the connected conveyance path 501*h*—the paper-money conveyance path 901*a*.

The upper conveyance path 50 and the lower conveyance path 90 pass through the paper-money discrimination unit 30 in dual directions to connect the money receipt/payment opening 20, the temporary holding unit 40, the money reception box 60, the recycle boxes 80*a* to 80*c*, and the exclusive storage box 202 together via the paper-money conveyance paths 501*a* to 501*h* and 901*a* to 901*d*.

In the lower paper-money mechanism 1*b*, the paper-money conveyance paths 901*a* to 901*d* in four locations on the front of the money reception box 60 and the recycle boxes 80*a* to 80*c* constitute the lower conveyance path 90, which can be integrally opened and closed, so that a maintenance personnel can open the lower conveyance path 90 to operate the money reception box 60 and the recycle boxes 80*a* to 80*c*.

The respective boxes, that is, the money reception box 60 and the recycle boxes 80*a* to 80*c* comprise a common housing outer shape, a paper-money entrance/exit port provided in a common position, and a common drive unit, and are constructed to be able to exchange one another and to be mounted to a storage mount part of the paper-money receipt/payment machine 1.

Figure 2:
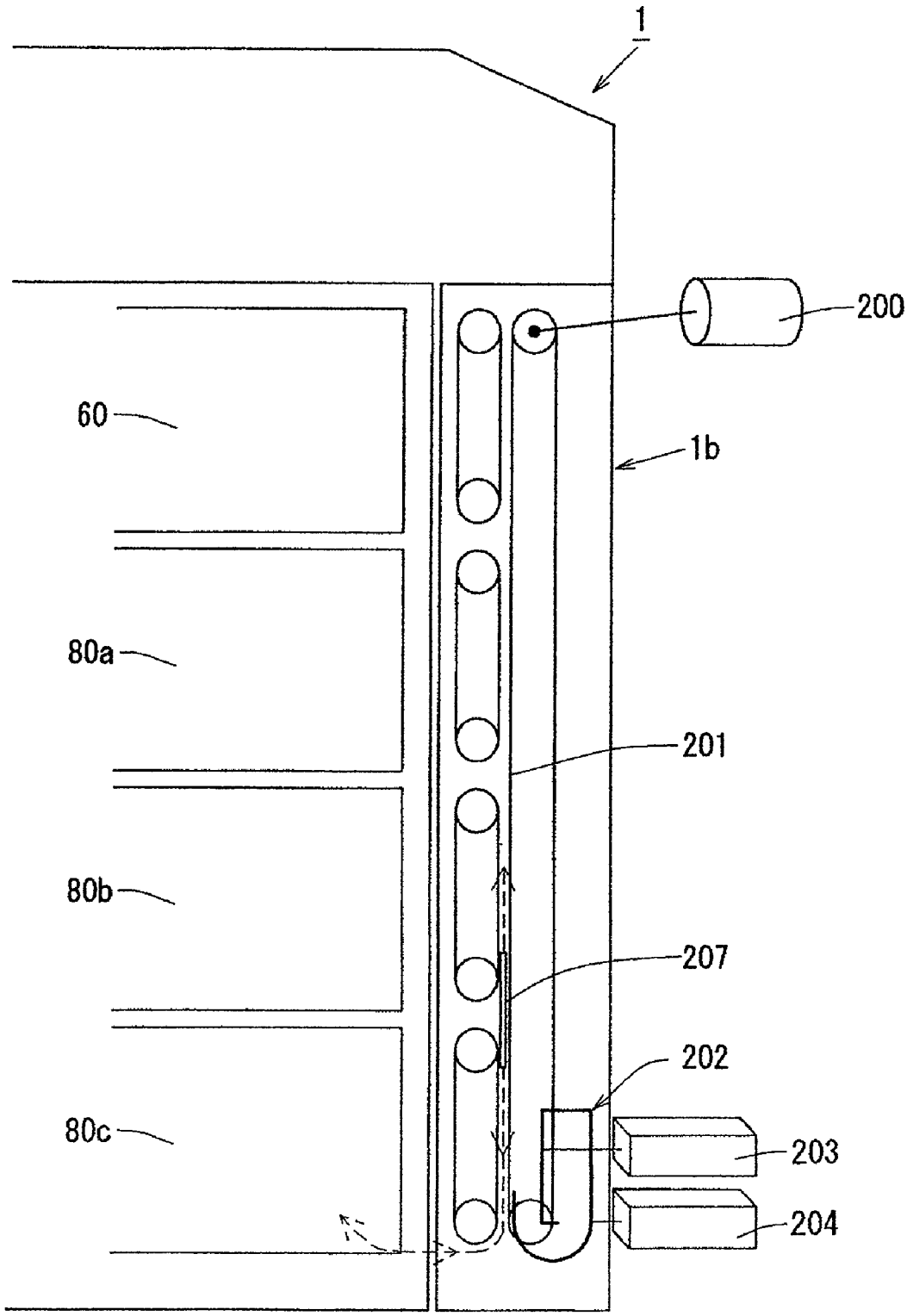
FIG. 2 is a side view showing a schematic construction of the first embodiment of the paper-money receipt/payment machine of the invention.
Figure 3:
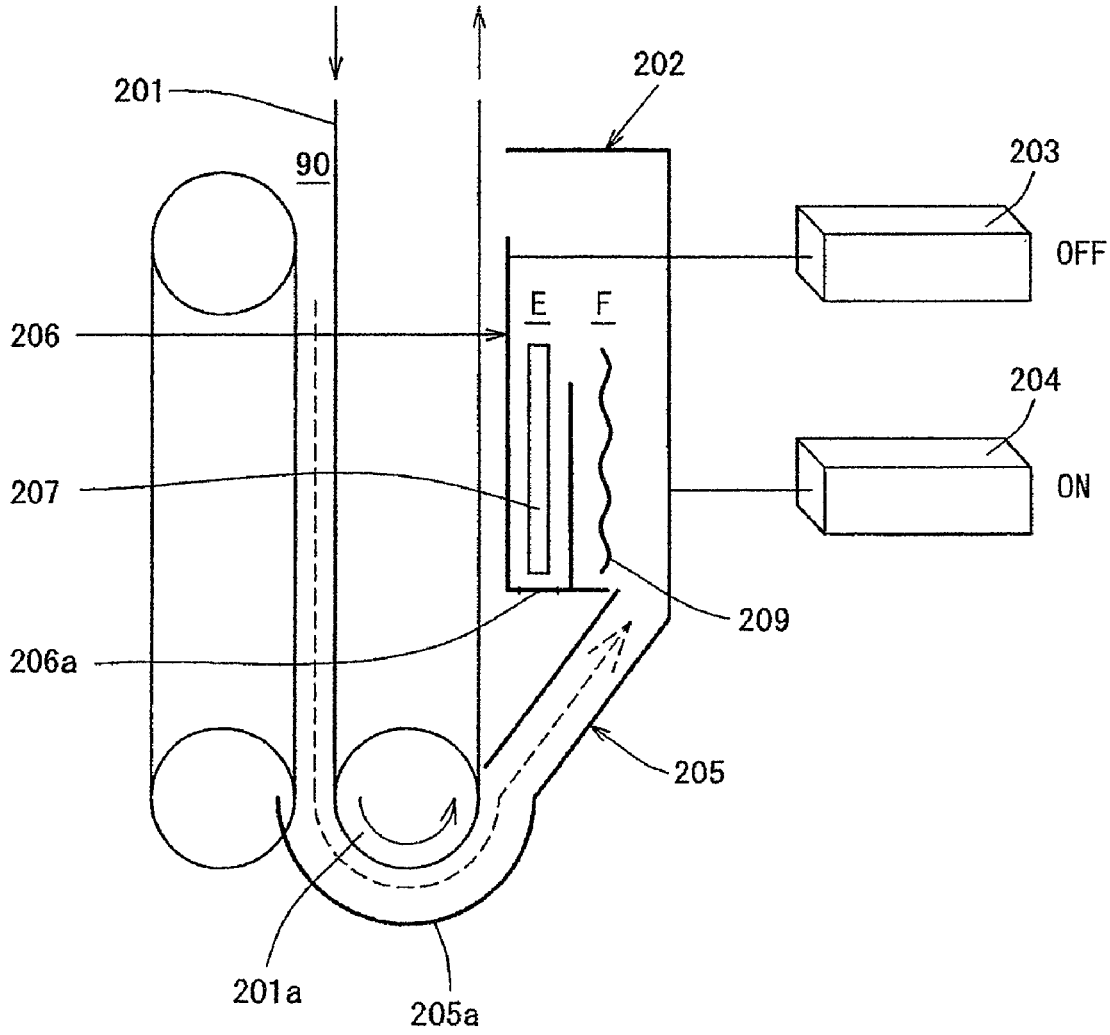
FIG. 3 is an enlarged side view showing a schematic construction of an exclusive storage box.
Figure 4:
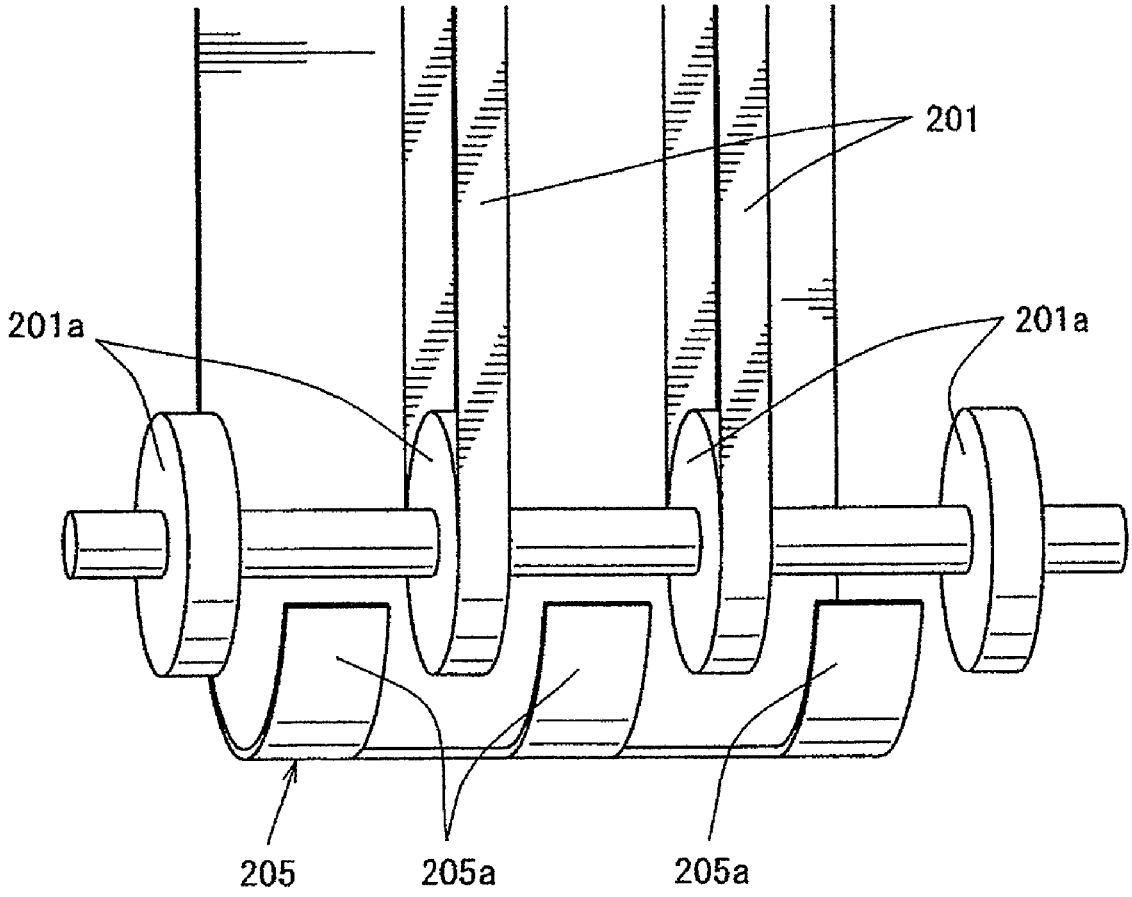
FIG. 4 is an enlarged front view showing a schematic construction of the exclusive storage box.

FIG. 2 is a side view showing an outline of the paper-money receipt/payment machine 1, FIG. 3 is an enlarged side view showing an outline of the exclusive storage box 202 of the paper-money receipt/payment machine 1, and FIG. 4 is an enlarged front view showing an outline of the exclusive storage box 202.

A lower conveyance belt 201 of the lower paper-money mechanism 1*b* simply represents a part of the paper-money conveyance paths 901*a* to 901*d* shown in FIG. 1. The lower conveyance belt 201 is driven by a lower paper-money conveyance mechanism motor 200. Two lengths of the lower conveyance belt 201 are provided in parallel in a conveyance width direction and stretched between two inner ones among four conveyance rollers 201*a* provided at a lower end thereof as shown in FIG. 4. The lower paper-money conveyance mechanism motor 200 drives the lower conveyance belt 201 whereby discharge/storage of paper money into the money reception box 60 and the recycle boxes 80*a* to 80*c* is carried out.

As shown in FIG. 3, the exclusive storage box 202 is mainly composed of a conveyance guide 205, a conveyance guide 206, and two solenoids 203, 204 for movement of the conveyance guides 205, 206.

Provided on a lower portion of the conveyance guide 205 are three semi-circular guide pawls 205*a*, which draw a curve sized larger than an outer periphery of the conveyance roller 201*a* provided at a lower end of the lower conveyance belt 201. The three guide pawls 205*a* are arranged laterally so as to be positioned between the respective four conveyance rollers 201*a* arranged laterally at intervals.

The guide pawls 205*a* of the conveyance guide 205 function as guidance means to lead an accumulated article/jammed paper money 209 into the exclusive storage box 202 and also function as guidance means when discharging/storing a conveyance path check sheet 207 onto a paper-money conveyance path (conveyance path by the lower conveyance belt 201) at the time of normal operation.

The conveyance guide 206 is a guide, which carries out discharge/storage of the conveyance path check sheet 207. A movable lid 206*a* (see FIG. 3) capable of opening and closing in a vertical direction is provided on a bottom portion of a storage space E of the conveyance guide 206. The movable lid 206*a* is maintained in a horizontal state by bias means such as spring, etc. and will not be caused by a weight of the conveyance path check sheet 207 to open downward in a state, in which the conveyance path check sheet 207 is placed thereon.

When the conveyance guide 206 is pushed against the lower conveyance belt 201 by the solenoid 203, the movable lid 206*a* is pushed open downward by the conveyance path check sheet 207, which is moved downward by receiving a conveying force of the lower conveyance belt 201.

Conversely, when the conveyance path check sheet 207 is to be stored, the movable lid 206*a* is pushed open upward by the conveyance path check sheet 207, which is moved upward by receiving a conveying force of the lower conveyance belt 201.

Figure 5:
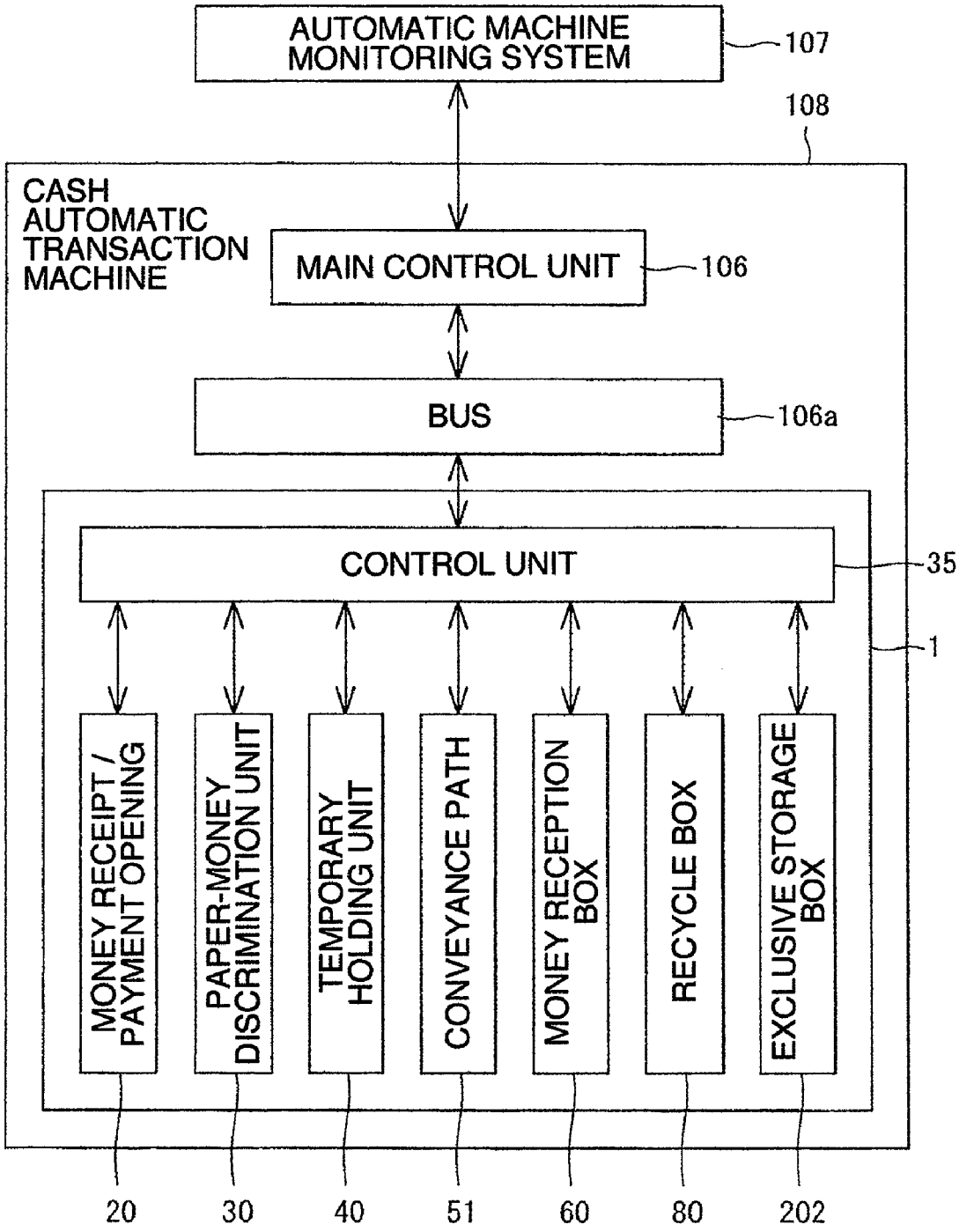
FIG. 5 is a block diagram showing the construction of the paper-money receipt/payment machine.

FIG. 5 is a block diagram showing the construction of the paper-money receipt/payment machine 1.

The paper-money receipt/payment machine 1 comprises the money receipt/payment opening 20, through which a user charges/takes out paper money, the paper-money discrimination unit 30 for discrimination of paper money, the temporary holding unit 40, in which paper money as received is once stored until transactions are closed, a conveyance path 51, plural kinds of the reception boxes (60, 80), which are detachable and store paper money therein, the exclusive storage box 202, and a control unit 35, which controls these mechanisms.

The reception boxes (60, 80) comprise the money reception box 60, in which paper money being not used for recycle is stored, and the recycle boxes 80*a* to 80*c*, which also serves as receipt/payment of money.

The conveyance path 51 comprises the upper conveyance path 50, the lower conveyance path 90, and the connected conveyance path 501*h* for connection thereof.

The control unit 35 is connected to a main control unit 106 of a cash automated-teller machine 108 through a bus 106*a* to control the paper-money receipt/payment machine 1 according to a command from the main control unit 106 and detection of a state of the paper-money receipt/payment machine 1. Also, a state of the paper-money receipt/payment machine 1 is transmitted to the main control unit 106 at need. Also, the control unit 35 is connected to drive motors of the respective units, that is, the money receipt/payment opening 20, the paper-money discrimination unit 30, the temporary holding unit 40, the conveyance path 51, the money reception box 60, the recycle boxes 80*a* to 80*c*, and the exclusive storage box 202, electromagnetic solenoids, and sensors in the paper-money receipt/payment machine 1 to drive and control the respective actuators (solenoids, motors, etc.) according to transactions while monitoring a state with the use of sensors.

The main control unit 106 is connected to an automatic machine monitoring system 107 through a circuit. The automatic machine monitoring system 107 monitors a state of the cash automated-teller machine 108 according to a signal received from the main control unit 106 to dispatch a maintenance personnel in case of abnormality to carry out maintenance of the cash automated-teller machine 108.

Subsequently, description will be given to the case where an accumulated article/jammed paper money is generated in various operations of the paper-money receipt/payment machine 1. Various operations of the paper-money receipt/payment machine 1 include a received money counting operation, a received money storing operation, and a money payment operation.

First, description will be given to the case where an accumulated article or jammed paper money stays on the upper conveyance path 50 of the paper-money receipt/payment machine 1 in the received money counting operation. Here, description is given taking as an example the case where the conveyance-path paper-money passage sensor 210*a* (see FIG. 1) of the upper paper-money mechanism 1*a* of the paper-money receipt/payment machine 1 detects stay of an accumulated article or generation of jammed paper money.

In this case, the control unit 35 moves a belt, which is connected to the upper conveyance path 50, a predetermined distance (or a predetermined period of time) in a reverse direction opposed to a forward direction being a direction of conveyance at the time of counting to convey an accumulated article or jammed paper money in the reverse direction, and then moves the belt again in the forward direction to convey the accumulated article or jammed paper money to the money receipt/payment opening 20. When the direction of conveyance is switched over to the reverse direction, the control unit 35 functions as conveyance direction switching means at jam occasion.

In the case where the accumulated article or jammed paper money cannot be conveyed in the reverse direction at the time of conveyance in the reverse direction (that is, in the case where conveyance of the accumulated article or jammed paper money in the reverse direction cannot be detected by a sensor or the like), the accumulated article or jammed paper money is conveyed in the forward direction to be transported to the money receipt/payment opening 20.

After the accumulated article or jammed paper money is conveyed to the money receipt/payment opening 20 in this manner, the control unit 35 uses the conveyance path check sheet 207 (see FIG. 3) to carry out a foreign matter removal checking processing, in which it is confirmed that any foreign matter such as an accumulated article, jammed paper money, etc. is absent on the upper conveyance path 50 of the paper-money receipt/payment machine 1.

The foreign matter removal checking processing determines and checks whether the conveyance path check sheet 207 can be conveyed in a normal manner. The control unit 35, which carries out the foreign matter removal checking processing, functions as conveyance-path confirming means.

Figure 6:
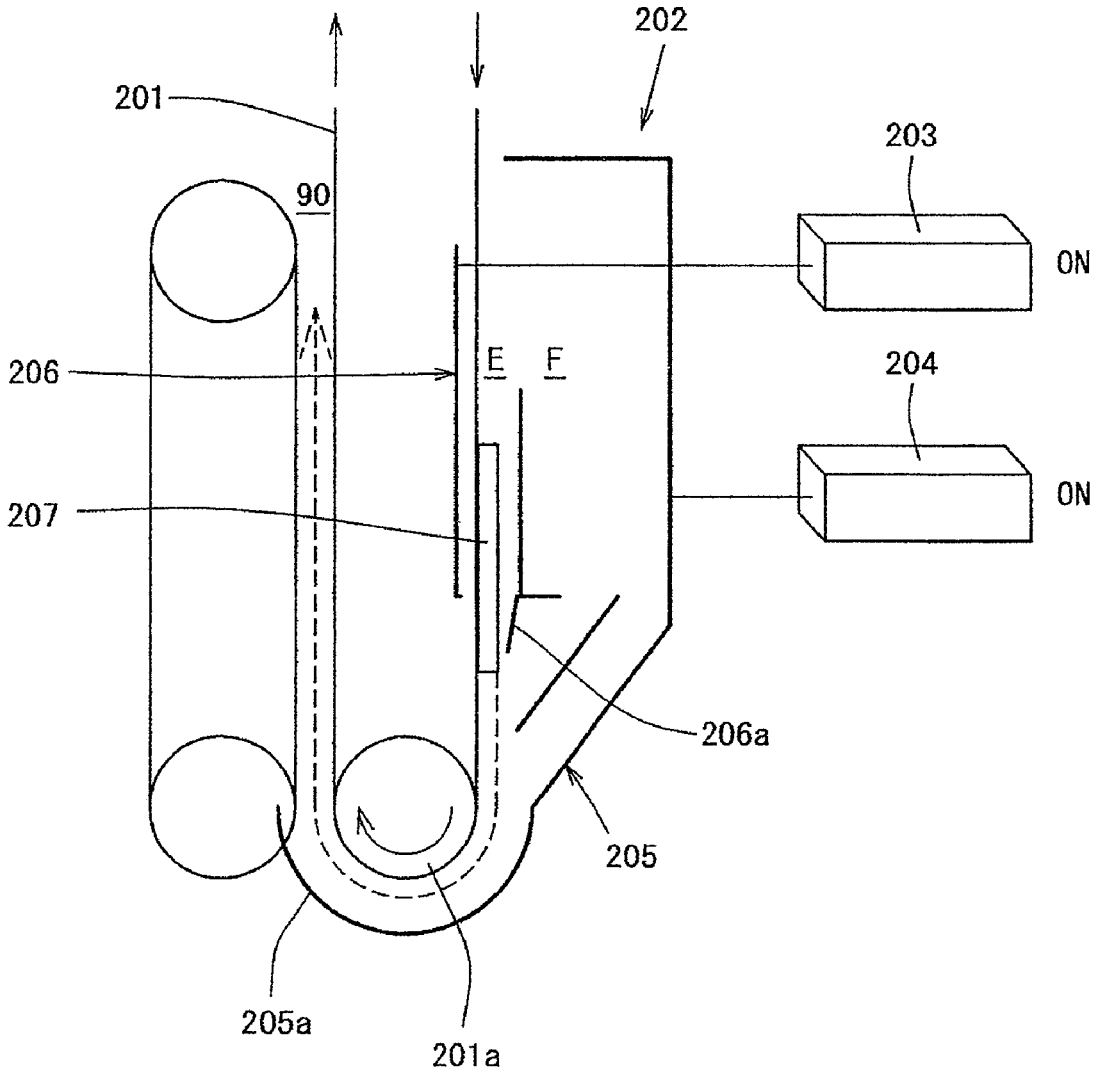
FIG. 6 is an enlarged side view showing a schematic construction of the exclusive storage box.

When the conveyance path check sheet 207 is discharged onto the conveyance path 51, the control unit 35 transmits a control signal to the exclusive storage box 202 to make both the solenoids 203, 204 ON as shown in the enlarged side view of FIG. 6.

Thereby, the conveyance guide 205 is put in a state, in which the guide pawls 205*a* shift to positions along the outer periphery of the conveyance roller 201*a* to be capable of discharge and storage. Also, the conveyance guide 206 moves to a position, in which it overlaps the lower conveyance belt 201 of the lower paper-money mechanism 1*b* as viewed in side view, to be put in a state, in which the conveyance path check sheet 207 stored in the storage space E as a conveyance-path confirming medium storage box is pushed against and brought into contact with the lower conveyance belt 201.

The conveyance path check sheet 207 is caused by a conveying force of the lower conveyance belt 201 to move downward to push open the movable lid 206*a* of the conveyance guide 206 to be discharged from the storage space E to be discharged onto the lower conveyance path 90 along the guide pawls 205*a*.

Figure 7:
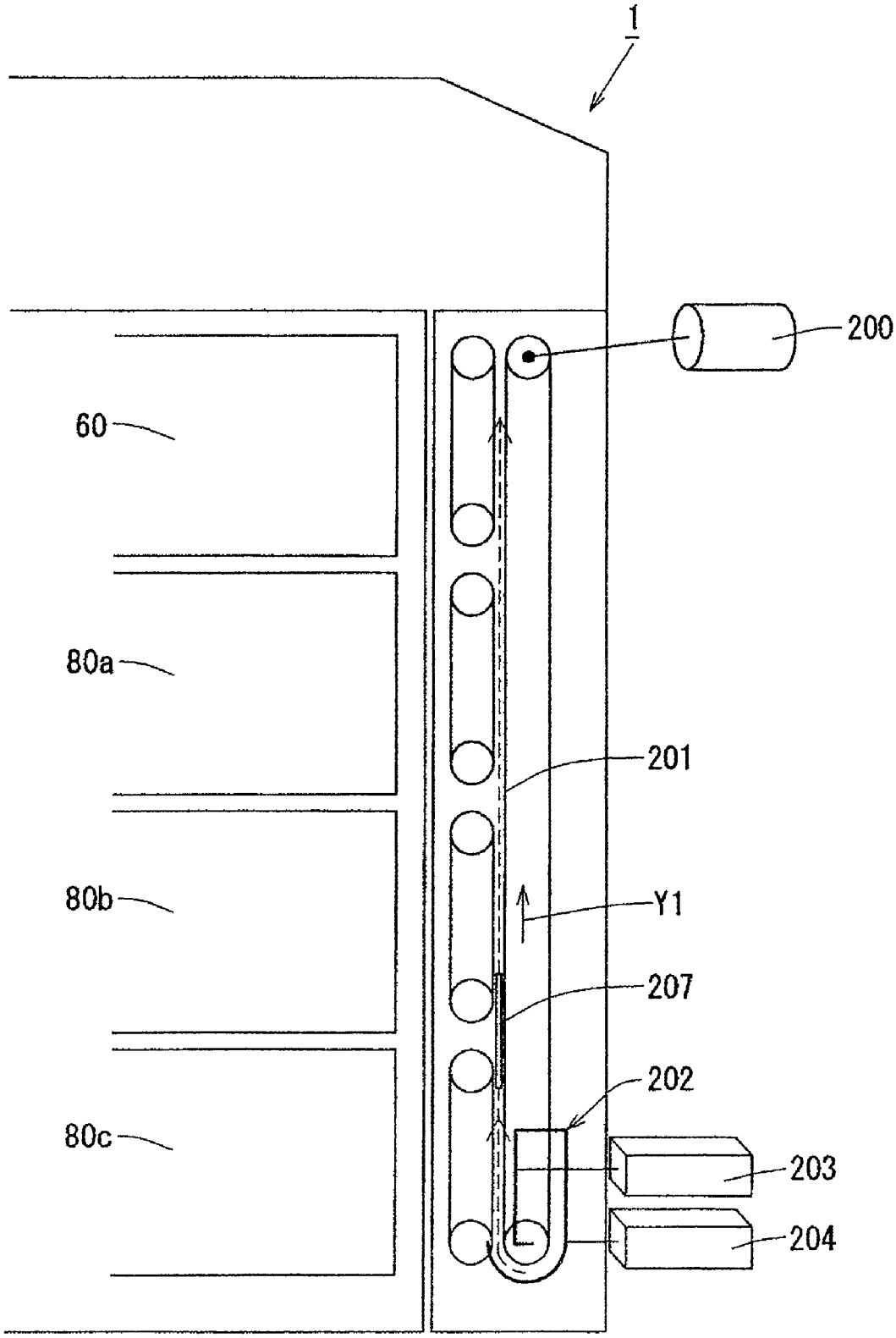
FIG. 7 is a side view showing a schematic construction of the paper-money receipt/payment machine.
Figure 8:
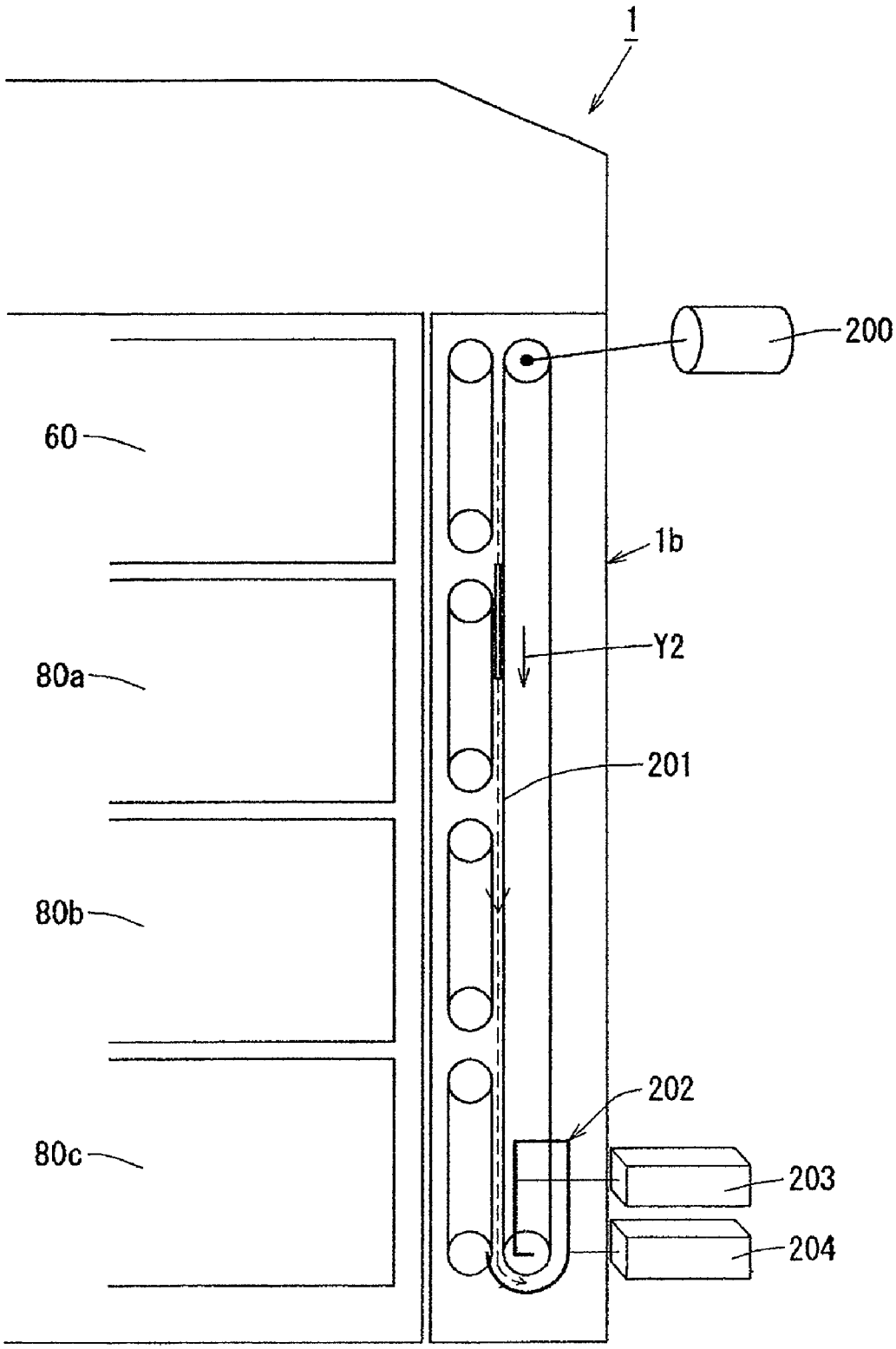
FIG. 8 is a side view showing a schematic construction of the paper-money receipt/payment machine.

As shown in a side view of FIG. 7, the conveyance path check sheet 207 thus discharged is conveyed over the conveyance path 51 in a direction of discharge as indicated by an arrow Y1 by the lower paper-money conveyance mechanism motor 200 and the lower conveyance belt 201 to check the conveyance path 51 as a whole.

The conveyance path check sheet 207 makes a round up to a distal end of the conveyance path 51 of the paper-money receipt/payment machine 1 to confirm that any accumulated article or jammed paper money is absent on the conveyance path 51, and then is reversely conveyed by the lower paper-money conveyance mechanism motor 200 and the lower conveyance belt 201 in flow of an arrow Y2 being a reverse direction to a direction at the time of discharge to be stored in the exclusive storage box 202.

Figure 9:
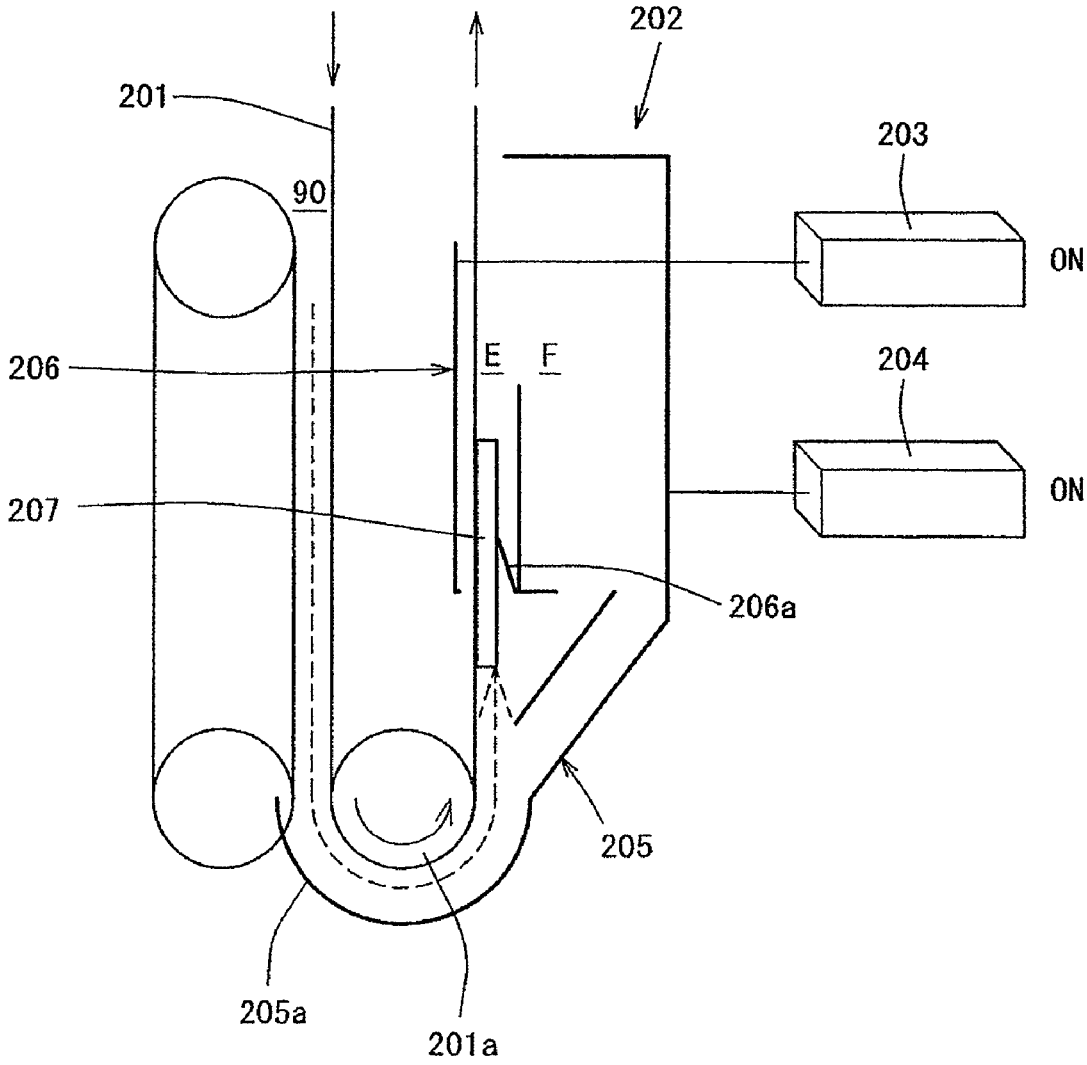
FIG. 9 is an enlarged side view showing a schematic construction of the exclusive storage box.

At the time of such storage in the exclusive storage box 202, both the solenoids 203, 204 are made ON by a control signal, which the control unit 35 transmits to the exclusive storage box 202, as shown in an enlarged side view of FIG. 9.

Accordingly, the conveyance path check sheet 207 is conveyed around the conveyance roller 201*a* along the guide pawls 205*a* of the conveyance guide 205 to push up the movable lid 206*a* of the conveyance guide 206 to be stored in the storage space E.

In this manner, after it is confirmed by the conveyance path check sheet 207 that any accumulated article or jammed paper money is absent on the conveyance path 51 of the paper-money receipt/payment machine 1, the control unit 35 opens a money receipt/payment shutter 20*a* of the money receipt/payment opening 20.

On the other hand, when the foreign matter removal checking processing is carried out, an accumulated article or jammed paper money stays in some cases on the conveyance path 51 of the paper-money receipt/payment machine 1 and the conveyance path check sheet 207 comes into contact with an accumulated article or jammed paper money whereby the sensor detects such stay.

In this manner, in the case where it is detected by the conveyance path check sheet 207 that an accumulated article is present, the direction of conveyance is switched over to a reverse direction to cause the conveyance path check sheet 207 to return to the exclusive storage box 202. At the same time, the accumulated article or jammed paper money is stored in the exclusive storage box 202.

The foreign matter removal checking processing with the use of the conveyance path check sheet 207 is carried out predetermined time or times (repeated plural times when the predetermined time is plural) to remove an accumulated article or jammed paper money present on the conveyance path 51 at the time of received money counting.

By carrying out the foreign matter removal processing and the foreign matter removal checking processing at the time of received money counting, jammed paper money and paper money remaining on the conveyance path 51 can be wholly conveyed to the money receipt/payment opening 20 to be surely returned to a user. Further, in the case where a user wants to deposit the returned paper money, it is also possible that a user straightens possible bent paper money and again opens the shutter of the money receipt/payment opening 20 to deposit money. Thereby, it is possible to fully automate removal of an accumulated article or jammed paper money present on the money conveyance path at the time of received money counting and resumption of normal operation.

Also, in the case where the conveyance path check sheet 207 detects presence of a remaining article, that is, in the case where jammed paper money at the time of received money counting cannot be returned to a user, paper money, which cannot be received, can be surely returned to a user by having a receipt or the like informing a user of the matter that jammed paper money is recovered, and returning that paper money, which is recovered into the exclusive storage box 202, to a user another day.

Also, in the case where the conveyance path check sheet 207 detects presence of remains, it is also possible to permit a user to deposit money again provided that remains such as paper money, etc. on the conveyance path 51 can be removed. Thereby, it is possible to fully automate resumption at the time of received money counting.

Figure 10:
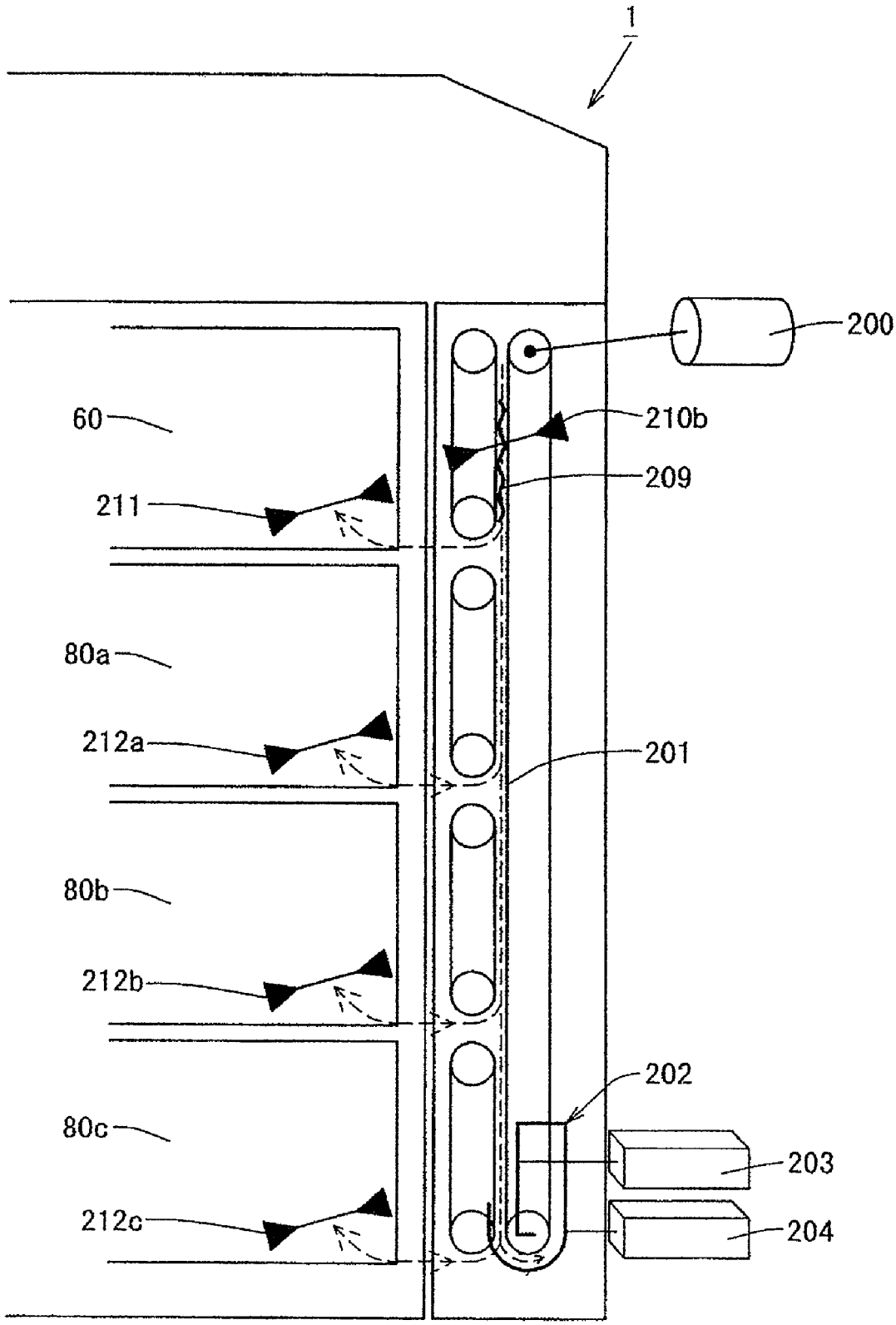
FIG. 10 is a side view showing a schematic construction of the paper-money receipt/payment machine.

Subsequently, description will be given to the case where an accumulated article or jammed paper money stays on the conveyance path 51 of the paper-money receipt/payment machine 1 at the time of storage after a user charges paper money to confirm an amount of money, that is, at the time of money reception. Here, description is given to the case where a conveyance-path paper-money passage sensor 210*b* shown in a side view of FIG. 10 detects a state as dark for the duration except a predetermined period of time and an accumulated article or jammed paper money 209 is present, and the case where passage sensors 211, 212*a* to 212*c* in the money reception box 60 and the recycle boxes 80*a* to 80*c* cannot confirm paper money within a predetermined period of time.

It is assumed that an accumulated article or jammed paper money 209 is present about, for example, the conveyance-path paper-money passage sensor 210*b* of the lower paper-money mechanism 1*b* of the paper-money receipt/payment machine 1 at the time of money reception and the accumulated article or jammed paper money 209 cannot be conveyed in a direction of reception. In this case, after the lower conveyance belt 201 connected to the lower conveyance path 90 of the lower paper-money mechanism 1*b* is moved a predetermined distance (or a predetermined period of time) in a forward direction opposed to the direction of reception to move the accumulated article or jammed paper money 209 in the forward direction, the lower conveyance belt 201 thus connected is used to convey the accumulated article or jammed paper money 209 in the reverse direction to store the accumulated article or jammed paper money 209 in the exclusive storage box 202.

Also, in the case where it is not possible to convey the accumulated article or jammed paper money 209 in the forward direction, the lower conveyance belt 201 is conveyed in the reverse direction to store the accumulated article or jammed paper money 209 in the exclusive storage box 202.

When the accumulated article or jammed paper money 209 is to be stored in the exclusive storage box 202, the solenoid 204 for the exclusive storage box 202 is made "ON" by a control signal of the control unit 35 as shown in FIG. 3. Thereby, the conveyance guide 205 is put in a state, in which the guide pawls 205*a* shift to positions along the outer periphery of the conveyance roller 201*a* to be capable of storage. Also, at this time, the solenoid 203 is made "OFF" and the conveyance guide 206 is put in a state separate from the lower conveyance belt 201.

A conveying force of the lower conveyance belt 201 causes the accumulated article or jammed paper money 209 to move along the guide pawls 205*a* to be stored in a storage space F. After the accumulated article or jammed paper money 209 is stored in the exclusive storage box 202, the control unit 35 carries out a remains confirming processing to confirm whether an accumulated article or jammed paper money remains on the conveyance path 51 of the paper-money receipt/payment machine 1. The remains confirming processing is almost the same as a foreign matter removal checking processing subsequent to the foreign matter removal processing at the time of received money counting described above. A difference resides in that remains are returned to the money receipt/payment opening 20 at the time of received money counting but remains are not returned to the money receipt/payment opening 20 at the time of money reception and only presence of remains is confirmed.

Also, the control unit 35 carries out the foreign matter removal checking processing described above to perform confirmation of remains and storage into the exclusive storage box 202 in the case where remains are present.

By carrying out the foreign matter removal processing and the foreign matter removal checking processing at the time of money reception, all jammed paper money and paper money remaining on the conveyance path 51 can be recovered into the exclusive storage box 202.

Also, even in the case where presence of remains is detected by the conveyance path check sheet 207, remains such as paper money, etc. on the conveyance path 51 can be removed, so that it is possible to fully automate resumption at the time of money reception.

Also, in the case where presence of remains is detected by the conveyance path check sheet 207, paper money, which cannot be received and stored, can be surely returned to a user by having a receipt or the like informing the user of the matter that jammed paper money is recovered, and returning paper money, which is recovered into the exclusive storage box 202, to the user another day.

Subsequently, description will be given to the case where an accumulated article or jammed paper money stays on the conveyance path 51 of the paper-money receipt/payment machine 1 at the time of money payment. Here, description is given to the case where, for example, the conveyance-path paper-money passage sensor 210*b* (see FIG. 10) detects a state as dark for a predetermined period of time and an accumulated article or jammed paper money 209 is present, or the case where the passage sensors 211, 212*a* to 212*c* in the money reception box 60 and the recycle boxes 80*a* to 80*c* cannot confirm paper money within a predetermined period of time.

It is assumed that an accumulated article or jammed paper money 209 is present about, for example, the conveyance-path paper-money passage sensor 210*b* of the lower paper-money mechanism 1*b* of the paper-money receipt/payment machine 1 at the time of money payment. In this case, after the lower conveyance belt 201 connected to the lower conveyance path 90 is moved a predetermined distance (or a predetermined period of time) in a direction of money payment to move the accumulated article or jammed paper money 209, the lower conveyance belt 201 is conveyed in the reverse direction to store the accumulated article or jammed paper money 209 in the exclusive storage box 202. Here, the reason for movement over a predetermined distance in the direction of money payment is that in a midway state, in which paper money is partially discharged from paper money discharge ports of the money reception box 60 and the recycle boxes 80*a* to 80*c*, the paper money should be completely discharged onto the lower conveyance path 90.

In this manner, after removal of a foreign matter, the control unit 35 carries out the foreign matter removal checking processing described above. After it is confirmed in the foreign matter removal checking processing that any accumulated article or jammed paper money is absent on the conveyance path 51 of the paper-money receipt/payment machine 1, all paper money conveyed to the money receipt/payment opening 20 and paper money present on the conveyance path 51 are recovered into the money reception box 60 and the recycle boxes 80*a* to 80*c*, which correspond to respective paper money, and money is paid to a user again.

Thereby, it is possible to fully automate resumption to the normal operation from an abnormal state caused by an accumulated article or jammed paper money at the time of money payment.

Also, in the case where an accumulated article or jammed paper money remains on the conveyance path 51 of the paper-money receipt/payment machine 1 and the conveyance path check sheet 207 comes into contact with the accumulated article or jammed paper money to detect remains, the direction of conveyance is switched over to cause the conveyance path check sheet 207 to return to the exclusive storage box 202 and at the same time the accumulated article or jammed paper money are also stored in the exclusive storage box 202. Checking of the conveyance path with the conveyance path check sheet 207 is performed predetermined times. In this manner, resumption to the normal operation can be fully automated by removing an accumulated article or jammed paper money present on the paper money conveyance path.

After the foreign matter removal processing and the foreign matter removal checking processing, described above, at the time of received money counting, at the time of received money storage, and at the time of money payment are carried out, the main control unit 106 informs the automatic machine monitoring system 107 of the matter that jammed paper money and the conveyance path check sheet 207 are recovered into the exclusive storage box 202. Thereby, it is possible to dispatch a maintenance personnel to the apparatus, while the paper-money receipt/payment machine 1 operates upon automatic resumption, to recover jammed paper money in the exclusive storage box 202 and the conveyance path check sheet 207.

The paper-money receipt/payment machine 1 described above makes it possible to provide a paper-money handling apparatus capable of storage of a medium, such as an accumulated article of jammed paper money on the conveyance path 51, which has an adverse influence on operation, and confirmation of presence or absence of remains to enable resumption to be fully automated.

Therefore, it is possible to surely remove jammed paper money without assistance by a maintenance personnel or the like to automate resumption of the apparatus. Also, it is possible to reduce time, during which a maintenance personnel or the like is dispatched, thus enabling reducing maintenance cost in monetary facilities, etc., in which the paper-money receipt/payment machine 1 is installed. Further, since automated resumption makes it possible to shorten that duration, during which the apparatus is stopped, it is possible to improve the quality of service to a user.

Also, since the storage space E for storage of the conveyance path check sheet 207 and the storage space F for storage of the accumulated article or jammed paper money 209 are provided in the exclusive storage box 202 disposed in one location, assembly into the paper-money receipt/payment machine 1 is made possible at low cost and in a small space.

Also, only mechanistic modification of an existing module, in which the exclusive storage box 202 is mounted and control of the control unit 35 is added, makes it possible to provide a new or existing paper-money handling apparatus with the function of removing an accumulated article on a conveyance path.

Also, since the guide pawls 205*a* are commonly used for guidance of the conveyance path check sheet 207 to the storage space E from the lower conveyance path 90 and guidance of the accumulated article or jammed paper money 209 to the storage space F from the lower conveyance path 90, it is possible to decrease drive units to lead to manufacture at low cost and in a small space and to simplify control of the control unit 35. Also, it is possible to prevent an accumulated article and paper money in operation from being mixed.

Figure 11:
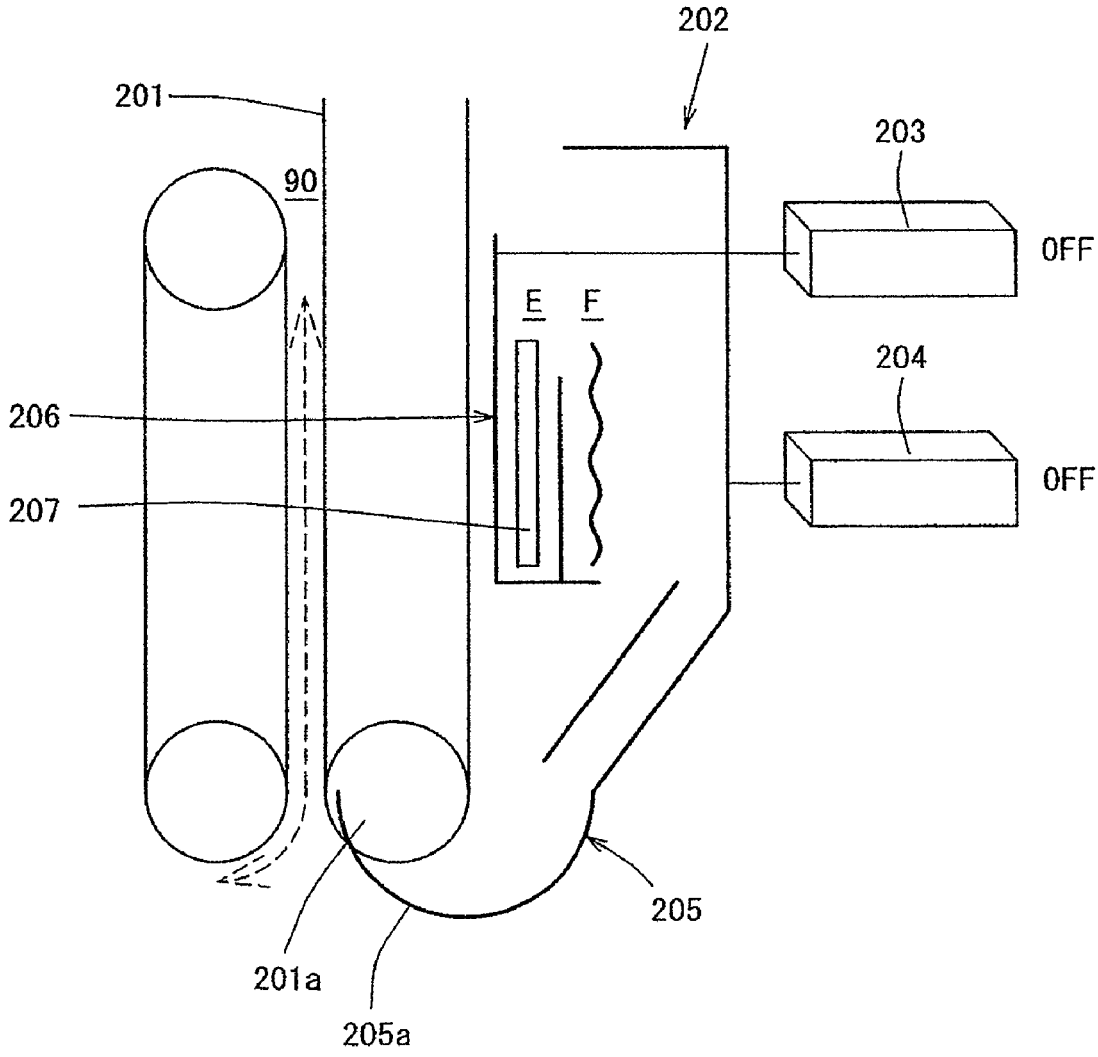
FIG. 11 is an enlarged side view showing a schematic construction of the exclusive storage box.

In addition, both the solenoids 203, 204 in the exclusive storage box 202 are made "OFF" in a normal state, in which a foreign matter such as accumulated article, jammed paper money, etc. is not detected. Therefore, as shown in an enlarged side view of FIG. 11, the guide pawls 205*a* of the conveyance guide 205 retreat from the lower conveyance path 90, so that paper money conveyed on the lower conveyance path 90 cannot be taken into the exclusive storage box 202. Also, since the conveyance guide 206 is not in contact with the lower conveyance belt 201, the conveyance path check sheet 207 is not discharged. Accordingly, the exclusive storage box 202 does not have any influence on normal operation of the paper-money receipt/payment machine 1.

Second Embodiment

Figure 12:
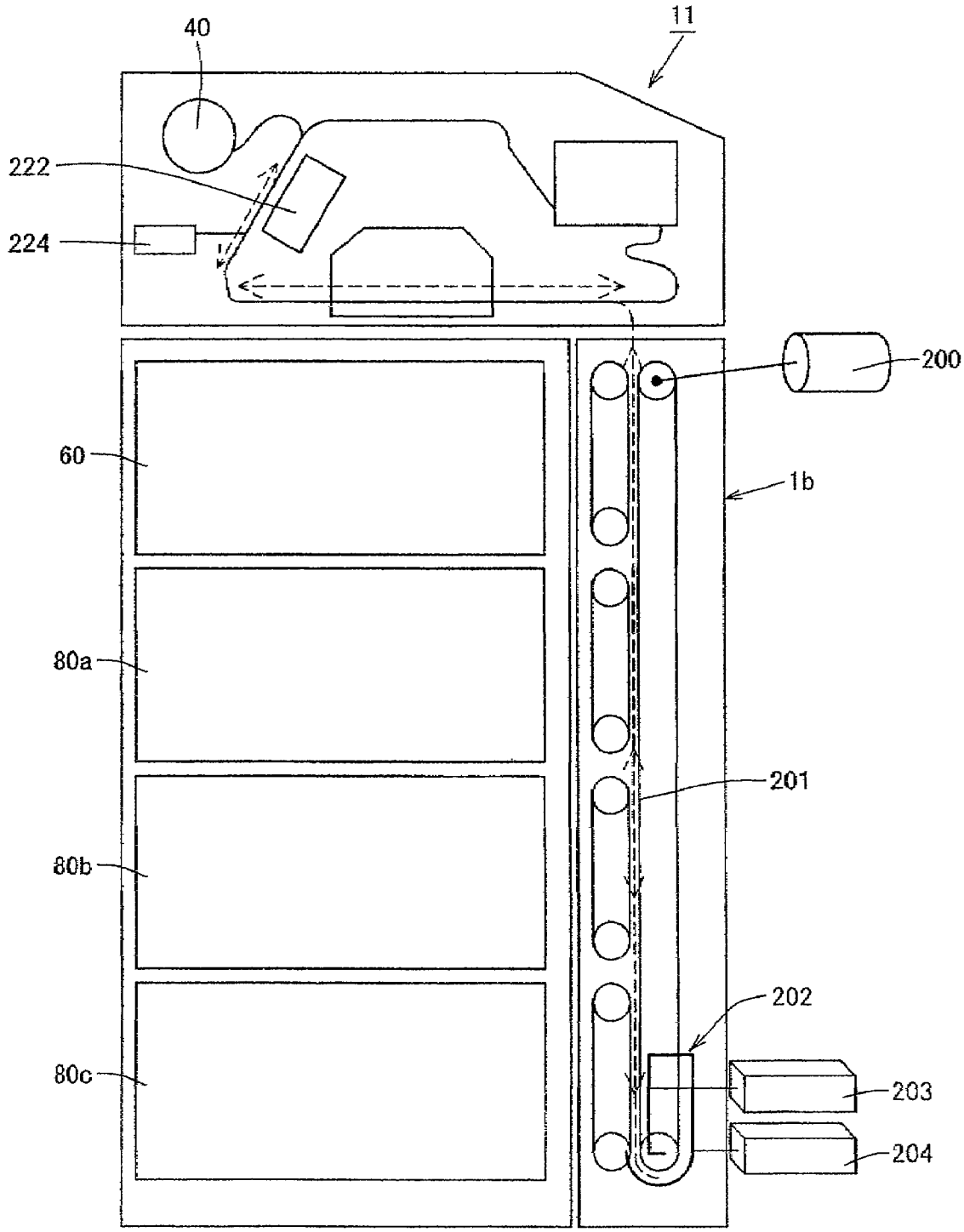
FIG. 12 is a side view showing a schematic construction of a second embodiment of the paper-money receipt/payment machine according to the invention.

A paper-money receipt/payment machine 11, in which an exclusive storage box 202 is provided at both ends (both ends of a conveyance path capable of conveyance in dual directions) of a conveyance path 51, will be described as a second embodiment with reference to a side view of the paper-money receipt/payment machine 11 shown in FIG. 12. In this case, an exclusive storage box 222 is provided in a position near a temporary holding unit 40 on an upper conveyance path 50 in addition to the exclusive storage box 202 according to the first embodiment.

The exclusive storage box 222 functions only to store an accumulated article or jammed paper money and is switched over by a solenoid 224 between a state communicated to the upper conveyance path 50 and a state separated therefrom. The exclusive storage box 222 and the exclusive storage box 202 provide a construction, in which storage boxes are present at both ends of the conveyance path 51. Since the remaining construction is the same as that of the first embodiment, the same reference numerals denote the same constituent elements as those in the latter and a detailed description therefor is omitted.

At the time of received money counting, the paper-money receipt/payment machine 11 according to the second embodiment carries out the same operation as that in the first embodiment.

At the time of money reception, the control unit 35 makes a solenoid 224 at a conveyance switchover gate "ON" in the case where an accumulated article or jammed paper money is generated on the conveyance path 51. Thereby, the upper conveyance path 50 and the exclusive storage box 222 are connected to each other to convey the accumulated article or jammed paper money in a forward direction to store the same in the exclusive storage box 222. Thereby, the accumulated article or jammed paper money is removed from the upper conveyance path 50.

Here, the reason why conveyance in the forward direction is made is that in many cases, jammed paper money can be conveyed in the forward direction but not in a reverse direction. Described in detail, the conveyance path 51 is operated in the reverse direction at the time of storage to store paper money, so that paper money can be caught by a guide or the like on the conveyance path 51 to be folded in some cases. When jammed paper money being thus folded is conveyed in the same reverse direction, a portion as folded is again caught by the guide and so cannot be conveyed.

When storage into the exclusive storage box 222 is completed, the foreign matter removal checking processing described in the first embodiment is carried out, and after the conveyance path check sheet 207 is discharged from the exclusive storage box 202 to make a round on the conveyance path 51, it is stored in the exclusive storage box 202.

Thereby, it is possible to fully automate removal of an accumulated article or jammed paper money on the conveyance path 51 and resumption of normal operation at the time of money reception.

The same operation as that in the first embodiment is carried out at the time of money payment. The reason why conveyance is made in the reverse direction when an accumulated article or jammed paper money is present at the time of money payment is that in many cases, jammed paper money can be conveyed in the reverse direction but not in the forward direction according to a state of jam. Described in detail, the conveyance path 51 is operated in the forward direction at the time of money payment to convey paper money to the money receipt/payment opening 20, and at that time, paper money can be caught by a guide or the like on the conveyance path 51 to be folded. When jammed paper money being thus folded is conveyed in the same forward direction, a portion as folded is again caught by the guide and so cannot be conveyed.

The operation of removal of a foreign matter at the time of money payment makes it possible to fully automate removal of an accumulated article or jammed paper money present on the conveyance path 51 and resumption to the normal operation at the time of money payment.

In this manner, when the exclusive storage boxes 202, 222 are provided at both ends of the conveyance path 51, it is possible to further heighten automatic resumption in reliability, thus enabling further shortening that duration, during which the apparatus is stopped.

Third Embodiment

Figure 13:
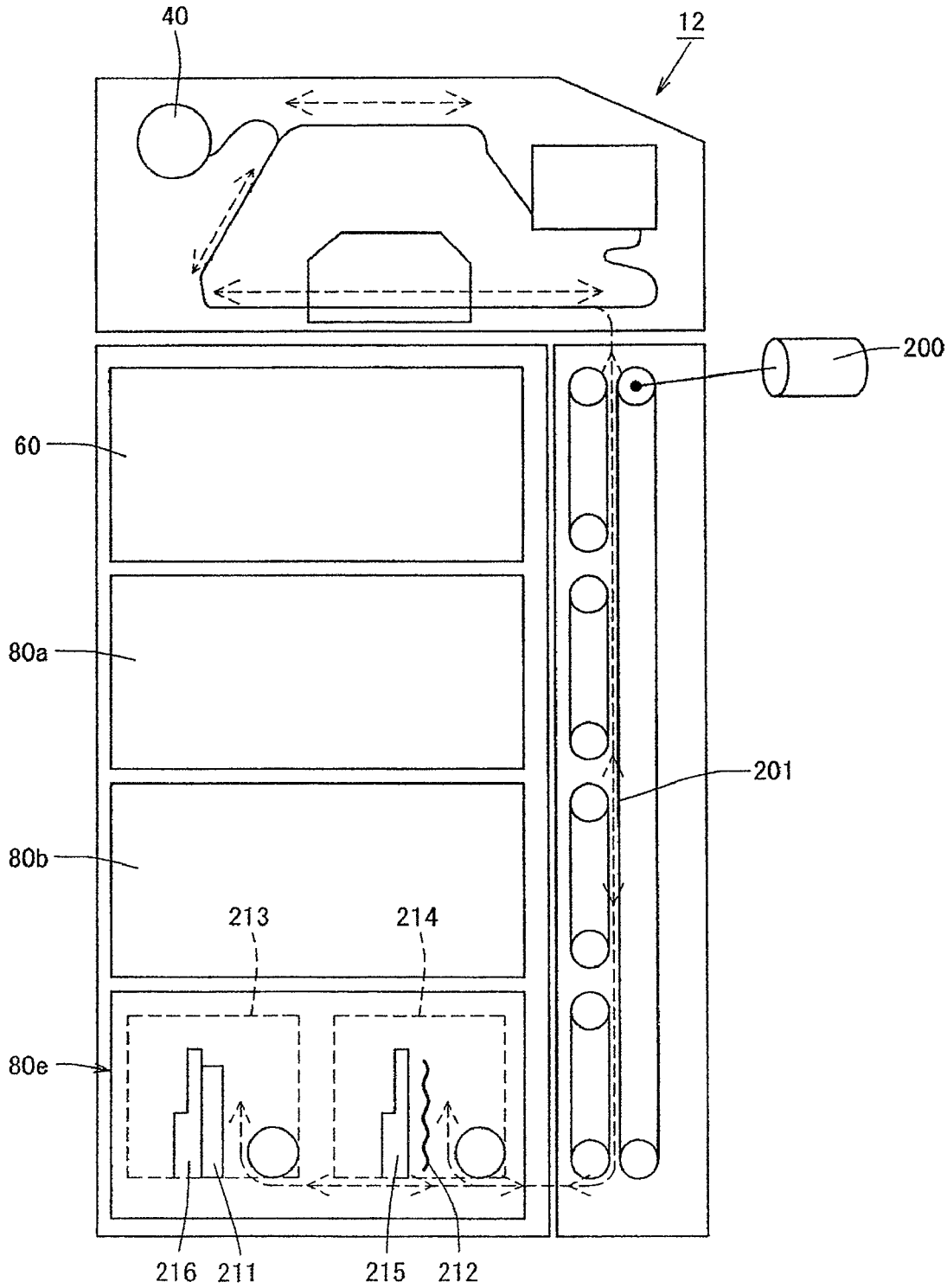
FIG. 13 is a side view showing a schematic construction of a third embodiment of the paper-money receipt/payment machine according to the invention.

A paper-money receipt/payment machine 12, in which instead of the exclusive storage box 202, a recycle box **80*e* including two parts, that is, a recycle portion 213 and a storage space 214 is provided at a distal end of a conveyance path 51, will be described as a third embodiment with reference to a side view of the paper-money receipt/payment machine 12 shown in FIG. 13**.

The recycle portion 213 and the storage space 214 are provided as two recycle spaces in the recycle box **80*e*, and the both spaces can perform discharge/storage of paper money and, respectively, can be made use of as a recycle box. The remaining recycle boxes 80*a* to 80*c* comprise one recycle space and the recycle box 80*e* is different in this respect from the remaining recycle boxes 80*a* to 80*c***.

Since one box is divided into two spaces, that is, the recycle portion 213 and the storage space 214 to be used, the recycle box **80*e*** is small in paper money storage volume but is adequately useful in case of being used for recycle of large denomination paper money and denomination paper money of small frequency in use.

The storage space 214 of the recycle box **80*e* is used to store jammed paper money and the recycle portion 213 is set to perform discharge/storage of the conveyance path check sheet 207**.

Use of the storage space 214 enables the same operation as that of the conveyance guide 205 in the exclusive storage box 202 described in the first embodiment, which stores an accumulated article or jammed paper money. Also, use of the recycle portion 213 enables the same operation as that of the conveyance guide 206 in the exclusive storage box 202 described in the first embodiment, which performs discharge/storage of the conveyance path check sheet 207.

Since the remainder of the construction is the same as that in the first embodiment, the same elements as those in the latter are denoted by the same reference numerals as those in the latter and a detailed description therefor is omitted.

Respective operations of the paper-money receipt/payment machine 12 at the time of received money counting, at the time of money reception, and at the time of money payment are the same as those in the first embodiment except that an accumulated article or jammed paper money is stored in the storage space 214 and the conveyance path check sheet 207 is stored in the recycle portion 213.

When an accumulated article or jammed paper money is stored in the storage space 214, the accumulated article or jammed paper money is conveyed into the recycle box 80*e* via the lower conveyance belt 201. The accumulated article or jammed paper money is taken into the storage space 214 through a guide, depiction of which is omitted, and put in order by a push plate 215 to be stored.

When the conveyance path check sheet 207 is discharged from the recycle portion 213, the conveyance path check sheet 207 is caused by a push plate 216 to abut against a conveyance guide, depiction of which is omitted, and discharged onto the conveyance path 51.

When the conveyance path check sheet 207 is stored, the conveyance path check sheet 207 is conveyed into the recycle box 80*e* through the lower conveyance belt 201 and taken into the recycle portion 213 through a guide, depiction of which is omitted, to be stored by the push plate 216.

Accordingly, even in case of using the recycle box 80*e*, removal of an accumulated article or jammed paper money, in the first embodiment described above, at the time of received money counting, at the time of money reception, and at the time of money payment is enabled, so that resumption to the normal operation can be fully automated.

In addition, mechanically connected portions of the money reception box 60, which serves as a paper sheet storage box for money reception and payment, the recycle boxes 80*a* to 80*c*, and the recycle box 80*e*, which serves as a jammed paper sheet reception box and a conveyance-path confirming medium, are identical with each other, and respective storage portions, which stores these boxes, are identical with each other in construction so that the respective boxes can be mutually exchanged in the respective storage portions. Accordingly, by exchanging the money reception box 60, the recycle boxes 80*a* to 80*c*, and the recycle box 80*e* mutually, a combination can be freely switched over according to a configuration of operation such that emphasis is laid on an operation for an increase in recycle denomination, and emphasis is laid on an operation for an increase in volume of stored paper money.

The invention is not limited to only the constructions of the embodiments described above but it is possible to obtain many embodiments.

According to the invention, it is possible to provide a paper-money handling apparatus, in which resumption can be fully automated even without intervention of a maintenance personnel or a clerk in charge.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A paper sheet handling apparatus comprising a conveyance path capable of conveying a paper sheet in dual directions;

a discrimination unit provided midway on the conveyance path to discriminate the paper sheet;

a rejected paper sheet storage box for storing a paper sheet rejected by the discrimination unit;

a jammed paper sheet storage box, separately provided from the rejected paper sheet storage box, for storing a jammed paper sheet, the jammed paper sheet storage box being arranged at one end or both ends of the conveyance path;

a jam detection means that detects a jamming of the paper sheet on the conveyance path;

a jam occasion conveyance direction switching means that switches a conveyance direction on the conveyance path between a direction before jamming and a reverse direction in the case where jamming is detected by the jam detection;

a guide means that guides the jammed paper sheet, being conveyed, to the jammed paper sheet storage box; and a control unit for controlling the jam detection means, the jam occasion conveyance direction switching means and the guide means so that when jamming is detected by the jam detection means, the control unit controls the jam occasion conveyance direction switching means so as to move the conveyance path a predetermined distance in the reverse direction to solve the jamming and then to move the conveyance path in the direction before jamming so as to convey the jammed paper sheet to the jammed paper sheet storage box.

2. The paper sheet handling apparatus according to claim 1, further comprising:

a conveyance-path confirming medium storage box that stores a conveyance-path confirming medium for confirming the conveyance path; and a conveyance-path confirming means that conveys the conveyance-path confirming medium on the conveyance path after the jammed paper sheet is guided to the jammed paper sheet storage box.

3. The paper sheet handling apparatus according to claim 2, wherein the jammed paper sheet storage box and the conveyance-path confirming medium storage box are arranged close to each other, and the guide means is structured to be commonly used for guidance of the jammed paper sheet from the conveyance path to the jammed paper sheet storage box, and guidance of the conveyance-path confirming medium from the conveyance path to the conveyance-path confirming medium storage box.

4. The paper sheet handling apparatus according to claim 1, wherein the jammed paper sheet is a sheet that has caused a jam in a location on the conveyance path.

* * * * *